US010948838B2

(12) United States Patent
Anezaki et al.

(10) Patent No.: US 10,948,838 B2
(45) Date of Patent: Mar. 16, 2021

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Takashi Anezaki, Hiratsuka (JP); Taichi Sato, Numazu (JP); Kunihiko Sekido, Suntou-gun (JP); Masashi Nishi, Susono (JP); Atsushi Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/542,763

(22) Filed: Aug. 16, 2019

(65) Prior Publication Data

US 2020/0064749 A1 Feb. 27, 2020

(30) Foreign Application Priority Data

Aug. 24, 2018 (JP) ..... JP2018-157748
Aug. 8, 2019 (JP) ..... JP2019-146615

(51) Int. Cl.

| | |
|---|---|
| ***G03G 5/14*** | (2006.01) |
| ***G03G 5/087*** | (2006.01) |
| ***G03G 15/00*** | (2006.01) |
| ***G03G 21/18*** | (2006.01) |
| ***G03G 5/10*** | (2006.01) |

(52) U.S. Cl.

CPC ..... *G03G 5/144* (2013.01); *G03G 5/087* (2013.01); *G03G 5/102* (2013.01); *G03G 15/75* (2013.01); *G03G 21/1803* (2013.01); *G03G 2215/00962* (2013.01)

(58) Field of Classification Search

CPC ..... G03G 5/144

See application file for complete search history.

(56) References Cited

U.S. PATENT DOCUMENTS 3,630,743 A * 12/1971 Harvill ..... C01G 23/08 430/495.1
7,727,691 B2 * 6/2010 Miki ..... G03G 5/104 399/159
2006/0078726 A1 * 4/2006 Antonio ..... C01G 23/04 428/328
2008/0124641 A1 * 5/2008 Toriyama ..... G03G 5/144 430/84
2012/0121291 A1 * 5/2012 Tsuji ..... G03G 5/102 399/111
2015/0037236 A1 * 2/2015 Kageyama ..... C25B 11/04 423/385
2015/0241802 A1 * 8/2015 Fujii ..... G03G 5/144 430/57.1
2015/0316865 A1 * 11/2015 Noguchi ..... G03G 5/0542 430/56
2016/0231659 A1 * 8/2016 Tanaka ..... G03G 5/144
2018/0246425 A1 * 8/2018 Kuno ..... G03G 5/144
2018/0246426 A1 * 8/2018 Kuno ..... G03G 5/144
2018/0246427 A1 * 8/2018 Kaku ..... G03G 5/144
2018/0246441 A1 * 8/2018 Anezaki ..... G03G 15/162

FOREIGN PATENT DOCUMENTS

JP 07295245 A * 11/1995
JP 2007334334 A * 12/2007
JP 2007334334 A 12/2007

OTHER PUBLICATIONS

English language machine translation of JP 2007-334334 (Dec. 2007). (Year: 2007).*
English language machine translation of JP 07-295245 (Nov. 1995). (Year: 1995).*
Yoon, S.D; Harris, V.G.; Vittoria, C. "Electronic Transport in the Oxygen Deficient Ferromagnetic Semiconducting TiO2-delta" J. Phys.: Condens. Matter 19 (2007) 326202 (7pp). (Year: 2007).*
He, Q; Hao, Q.; Chen, G.; Poudel, B.; Wang, X.; Dezhi, W.; Ren, Z. "Thermoelectric property studies on bulk TiOx with x from 1 to 2" Applied Physics Letters 91, 052505 (Year: 2007).*

* cited by examiner

*Primary Examiner* — Christopher D Rodee
(74) *Attorney, Agent, or Firm* — Rossi, Kimms & McDowell LLP

(57) ABSTRACT

There is provided an electrophotographic photosensitive member that can achieve both of an adequately high initial sensitivity as the electrophotographic photosensitive member and reduction in the fluctuation of a light portion potential at the time of repeated use. An electrophotographic photosensitive member includes a support, an electroconductive layer and a photosensitive layer in this order, wherein the electroconductive layer contains a binder material and a metal oxide particle; the metal oxide particle has a core material containing a titanium oxide, and a covering layer which covers the core material and contains the titanium oxide; and when the oxygen deficiency ratio of the metal oxide particle is represented by A, the oxygen deficiency ratio of the core material is represented by B, and the oxygen deficiency ratio of the covering layer is represented by C, the Expressions (1) and (2) are satisfied: $A \leq 2\%$ (1) and $10 \times B < C$ (2).

13 Claims, 3 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus including the electrophotographic photosensitive member.

Description of the Related Art

In electrophotographic photosensitive members used in an electrophotographic apparatus, it is known that an electroconductive layer containing metal oxide particles is provided between a support and a photosensitive layer for the purpose of concealing defects on the surface of the support. In order to achieve the above described purpose, it is necessary for the electroconductive layer to contain metal oxide particles of which the optical hiding power is high and a binder resin for binding the particles. A titanium oxide particle is known as a metal oxide particle of which the optical hiding power is high. When it is intended to obtain the electroconductivity of the electroconductive layer mainly by titanium oxide particles, black titanium oxide excellent in electroconductive performance can be used (Japanese Patent Application Laid-Open No. 2007-334334).

SUMMARY OF THE INVENTION

According to studies of the present inventors, it has been found out that in an electrophotographic photosensitive member described in Japanese Patent Application Laid-Open No. 2007-334334, there has been room for the electrophotographic photosensitive member to be improved in terms of compatibility between being adequately high in initial sensitivity and reducing the fluctuation of a light portion potential at the time of repeated use.

Accordingly, an object of the present disclosure is to provide an electrophotographic photosensitive member that can achieve both of the adequately high initial sensitivity as the electrophotographic photosensitive member and reduction in the fluctuation of the light portion potential at the time of the repeated use.

The object is achieved by the following present disclosure. That is, the electrophotographic photosensitive member according to the present disclosure is an electrophotographic photosensitive member including a support, an electroconductive layer and a photosensitive layer in this order, wherein the electroconductive layer contains a binder material and a metal oxide particle; the metal oxide particle has a core material containing a titanium oxide, and a covering layer which covers the core material and contains the titanium oxide; and when the oxygen deficiency ratio of the metal oxide particle is represented by A, the oxygen deficiency ratio of the core material is represented by B, and the oxygen deficiency ratio of the covering layer is represented by C, the following Expression (1) and Expression (2) are satisfied:

$$A \leq 2/100 \quad (1) \text{ and}$$

$$10 \times B < C \quad (2).$$

The present disclosure can provide an electrophotographic photosensitive member that can achieve both of an adequately high initial sensitivity as the electrophotographic photosensitive member and reduction in the fluctuation of the light portion potential at the time of the repeated use.

Further features of the present disclosure will become apparent from the following description of exemplary embodiments with reference to the attached drawings.

DESCRIPTION OF THE EMBODIMENTS

Figure 1:
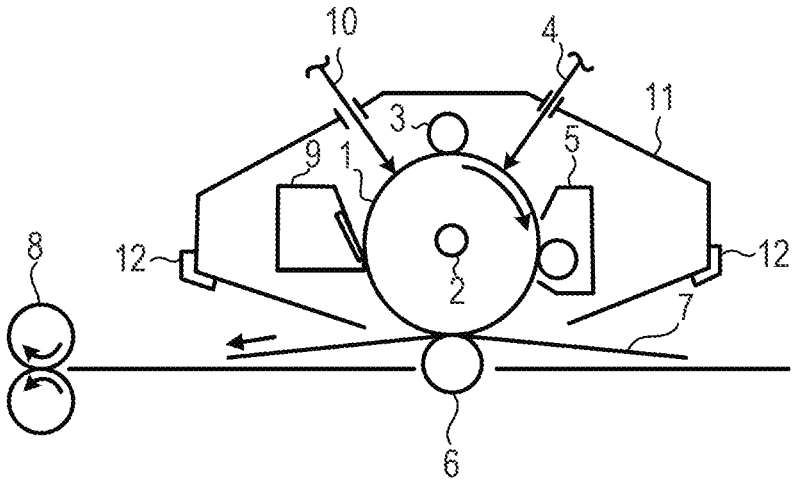
FIG. 1 is a view illustrating one example of a schematic configuration of an electrophotographic apparatus including a process cartridge including an electrophotographic photosensitive member.

Preferred embodiments of the present disclosure will now be described in detail in accordance with the accompanying drawings.

It is known that the initial sensitivity of an electrophotographic photosensitive member becomes higher as the amount of electric charges generated by a charge generation material in a photosensitive layer increases. Image exposure light which has entered the photosensitive layer of the electrophotographic photosensitive member is absorbed by the charge generation material when having entered the photosensitive layer, and generates an electric charge. Furthermore, the image exposure light is reflected by an inner layer after having passed through the photosensitive layer, is absorbed by the charge generation material also when having entered the photosensitive layer again, and generates an electric charge. Therefore, it relates to the initial sensitivity of the electrophotographic photosensitive member how much the image exposure light is reflected by the inner layer after having passed through the photosensitive layer.

In an electrophotographic photosensitive member that has a support, an electroconductive layer and a photosensitive layer in this order, image exposure light which has passed through the photosensitive layer is reflected by the electroconductive layer. As a result of studies by the present inventors, it has been found that there is a correlation in which the higher the luminosity of the electroconductive layer is, the higher the initial sensitivity of the electrophotographic photosensitive member is. The reason is because the higher the luminosity of the electroconductive layer is, the higher the quantity of reflected light of the image exposure light by the electroconductive layer is, and the lower the luminosity of the electroconductive layer is, the lower the quantity of the reflected light of the image exposure light by the electroconductive layer is.

By the way, the electroconductive layer is required to have a sufficient electroconductive performance to smoothly pass the electric charge generated in the photosensitive layer to the support. As is described in Japanese Patent Application Laid-Open No. 2007-334334, when a layer having the electroconductivity is provided between the support and the photosensitive layer, black titanium oxide excellent in electroconductive performance can be used as the metal oxide particle. However, as a result of the studies by the present inventors, it has been found out that when the black titanium oxide has been used for the electroconductive layer between the support and the photosensitive layer, the initial sensitivity of the electrophotographic photosensitive member becomes low. The reason is considered to be because by using the black titanium oxide for the electroconductive layer, the luminosity of the electroconductive layer is lowered and the quantity of reflected light of the image exposure light by the electroconductive layer is lowered.

In order to solve the technical problems caused in the conventional arts, the present inventors have made studies about a metal oxide particle to be used for the electroconductive layer. As a result of the above described studies, it has been found that the technical problems which have occurred in conventional technologies can be solved by using a metal oxide particle, as a metal oxide particle to be used for the electroconductive layer, which has a core material containing a titanium oxide, and a covering layer which covers the core material and contains a titanium oxide, and satisfies the following Expression (1) and Expression (2) when the oxygen deficiency ratio of the metal oxide particle is represented by A, the oxygen deficiency ratio of the core material is represented by B, and the oxygen deficiency ratio of the covering layer is represented by C:

$$A \leq 2\% \text{ (i.e., } 2/100) \quad (1) \text{ and}$$

$$10 \times B < C \quad (2).$$

The metal oxide particle of the present disclosure includes that the core material which contains a titanium oxide having a low oxygen deficiency ratio has a covering layer which contains a titanium oxide having a high oxygen deficiency ratio. Specifically, the metal oxide particle includes that the oxygen deficiency ratio of the covering layer is more than 10 times the oxygen deficiency ratio of the core material.

Generally, the titanium oxide particle can be deficient in oxygen which constitutes the titanium oxide particle, by being heated to a high temperature in a reducing atmosphere, and thereby can enhance the oxygen deficiency ratio. As the oxygen deficiency of the titanium oxide particle proceeds, the coloring of the titanium oxide particle proceeds and the luminosity decreases. The titanium oxide particle having a high oxygen deficiency ratio has a higher electroconductive performance than the titanium oxide particle having a low oxygen deficiency ratio, but the luminosity becomes lower. The titanium oxide particle of which the oxygen deficiency ratio has become high and the electroconductive performance has increased is generally black.

In addition, the oxygen deficiency ratio of the metal oxide particle of the present disclosure is 2% or less as a whole particle.

The metal oxide particle of the present disclosure keeps a high luminosity despite having a high electroconductive performance. The present inventors consider the reason as follows.

That is, the present inventors consider that the metal oxide particle of the present disclosure acquires the high electroconductive performance as a whole particle due to the covering layer in which oxygen is made deficient, and on the other hand, keeps the luminosity as the whole particle high by controlling the oxygen deficiency ratio of the core material to a low value.

Respective components can be synergistically affected by each other as described in the above mechanism, thereby allowing the effect of the present disclosure to be achieved.

[Electrophotographic Photosensitive Member]

The electrophotographic photosensitive member of the present disclosure includes a support, an electroconductive layer and a photosensitive layer in this order.

Examples of the method for producing the electrophotographic photosensitive member of the present disclosure include a method including preparing a coating liquid for each layer, described below, performing coating in desired layer order and drying the resultant. Examples of the coating method of the coating liquid here include dip coating, spray coating, inkjet coating, roll coating, die coating, blade coating, curtain coating, wire bar coating and ring coating. In particular, dip coating can be adopted in terms of efficiency and productivity.

Hereinafter, the support and respective layers will be described.

<Support>

In the present disclosure, the electrophotographic photosensitive member includes a support. In the present disclosure, the support can be an electroconductive support having electroconductivity. Examples of the shape of the support include a cylindrical shape, a belt shape and a sheet shape. In particular, a cylindrical support can be adopted. The surface of the support may also be subjected to an electrochemical treatment such as anodization, a blasting treatment, a centerless polishing treatment, a cutting treatment or the like.

The material of the support can be a metal, a resin, glass or the like.

Examples of the metal include aluminum, iron, nickel, copper, gold and stainless steel, and alloys thereof. In particular, an aluminum support using aluminum can be adopted.

The resin or glass may also have electroconductivity imparted by a treatment such as mixing of an electroconductive material or covering with such a material.

<Electroconductive Layer>

In the present disclosure, the electroconductive layer is formed on the support, and contains the metal oxide particle which includes a core material containing a binder material and a titanium oxide, and a covering layer which covers the core material and contains a titanium oxide. At this time, when the oxygen deficiency ratio of the metal oxide particle is represented by A, the oxygen deficiency ratio of the core material is represented by B, and the oxygen deficiency ratio of the covering layer is represented by C, the following Expression (1) and Expression (2) are satisfied:

$$A \leq 2\% \quad (1) \text{ and}$$

$$10 \times B < C \quad (2).$$

By satisfying the above described Expression (1) and Expression (2), the metal oxide particle is enabled to obtain the high electroconductive performance while keeping its luminosity high.

In the present disclosure, the oxygen deficiency ratio of the metal oxide particle can be determined by thermogravimetry (TG). When the metal oxide particle of the present disclosure is heated in an oxygen atmosphere, the mass decreases immediately after the start of a temperature rise due to the desorption of moisture and the like adsorbed to the surface of the metal oxide particle, and thereafter, increases from a certain temperature. The mass when the mass has not decreased but started to increase has been regarded as the minimum mass, and a difference from the maximum mass in the subsequent heating has been obtained. This difference is due to the oxygen deficient site in the metal oxide particle bound to oxygen.

In the present disclosure, the oxygen deficiency ratio of the metal oxide particle has been measured with the use of a thermogravimetric measurement apparatus (trade name: Q5000IR, manufactured by TA instruments Japan Inc.). The temperature rising rate at the time of measurement has been 10° C./min, and the measurement has been performed under an oxygen stream. The mass at a temperature at which the mass has started to increase in the range of 300° C. to 900° C. has been regarded as the minimum mass, and the oxygen deficiency ratio A has been determined from the minimum mass and the maximum mass which has been determined in the subsequent heating.

In the present disclosure, the oxygen deficiency ratio A of the whole metal oxide particle is 2% or less. From the viewpoint of keeping the luminosity of the particle high, the oxygen deficiency ratio A of the whole metal oxide particle is preferably 1% or less, and more preferably 0.5% or less. In addition, from the viewpoint of electroconductive performance, the oxygen deficiency ratio A of the whole metal oxide particle is preferably 0.01% or more, more preferably 0.03% or more, and further preferably 0.3% or more.

In addition, in the present disclosure, the ratio between the oxygen deficiency ratio of the core material in the metal oxide particle and the oxygen deficiency ratio of the covering layer therein can be measured by energy dispersive X-ray analysis (EDX).

In the present disclosure, the ratio between the oxygen deficiency ratio of the core material in the metal oxide particle and the oxygen deficiency ratio of the covering layer therein has been measured by SEM-EDX analysis on a cross section of the metal oxide particle.

As has been described above, in the present disclosure, when the oxygen deficiency ratio of the core material in the metal oxide particle is represented by B, and the oxygen deficiency ratio of the covering layer in the metal oxide particle is represented by C, the following Expression (2) is satisfied:

$$10 \times B < C \quad (2).$$

That is, C/B is 10 or more, which is the ratio of the oxygen deficiency ratio C of the covering layer in the metal oxide particle to the oxygen deficiency ratio B of the core material in the metal oxide particle.

In the metal oxide particle of the present disclosure, the electroconductive performance is considered to exhibit mainly due to the covering layer of the metal oxide particle. It means more selective deficiency of oxygen in the covering layer that the oxygen deficiency ratio of the covering layer is higher, that is, the value of C/B is larger. Therefore, the value of C/B is more preferably large from the viewpoint of electroconductive performance. From the viewpoint of electroconductive performance, the core material of the metal oxide particle may not be completely deficient in oxygen. In addition, from the viewpoint of the luminosity of the particle, the oxygen deficiency ratio of the core material in the metal oxide particle can be as low as possible.

In the present disclosure, preferably, 98 atomic % or more of metal elements contained in the core material of the metal oxide particle are the titanium element. The higher the purity of a titanium oxide of the core particle is, and the higher the crystallinity of the titanium oxide of the core particle is, the easier it is to prevent the core material from being reduced when the covering layer is reduced. More preferably, 99 atomic % or more of the metal elements contained in the core material of the metal oxide particle is the titanium element.

In addition, the ratio (% by mass) of the titanium element contained in the core material of the metal oxide particle can be determined also by performing ICP emission analysis on a powder of the same material as the particle used for the core material. The measurement is performed on a solution obtained by dissolving the material in an acid such as sulfuric acid.

In the present disclosure, 90 atomic % or more of metal elements contained in the metal oxide particle can be the titanium element. By controlling 90 atomic % or more of the metal elements contained in the metal oxide particle to be the titanium element, the metal oxide particle is enabled to have a high hiding power as the electroconductive layer.

In addition, the ratio (% by mass) of the titanium element contained in the metal oxide particle can also be measured with the use of an ICP emission analyzer. Layers other than the electroconductive layer of the electrophotographic photosensitive member are stripped, the electroconductive layer is scraped off, and the scraped electroconductive layer can be used as a measuring object. A powder of the same material as the metal oxide particle used in the electroconductive layer can also be used. The measurement is performed on a solution obtained by dissolving the powders with an acid such as sulfuric acid.

In addition, the ratio (% by mass) of the titanium element contained in the core material of the metal oxide particle and the ratio (% by mass) of the titanium element contained in the metal oxide particle can be also determined by energy dispersion X-ray analysis (EDX) on a cross section of the metal oxide particle.

In the present disclosure, the covering layer may further contain a foreign element such as niobium or tantalum. By an appropriate amount of foreign elements being contained, the oxygen deficiency ratio of the covering layer can be stabilized. By the oxygen deficiency ratio of the covering layer being stabilized, it can be suppressed that the oxygen deficiency site is oxidized during repeated use, and the electroconductive layer can further resist causing the lowering of the electroconductive performance.

In addition, the present inventors have found that in the high temperature and high humidity environment, the content of the niobium element or the tantalum element can be 0.5 atomic % or less of the metal elements contained in the above described covering layer. When the content of the niobium element or the tantalum element is 0.5 atomic % or less of the metal elements contained in the above described covering layer, the fluctuation of the light portion potential can be further reduced during the repeated use in a high temperature and high humidity environment.

The present inventors assume the reason why in the high temperature and high humidity environment, the fluctuation of the light portion potential during the repeated use is reduced when the content of niobium or tantalum in the covering layer is low, as follows.

The present inventors consider that in the high temperature and high humidity environment, a portion at which the niobium or tantalum element exists on the surface of the covering layer is apt to adsorb and hold the moisture, compared to a portion at which the niobium or tantalum element does not exist. In addition, the present inventors assume that the moisture excessively adsorbed to the surface of the covering layer hinders the movement of electric charges. From the above description, the present inventors assume that when the content of niobium or tantalum in the covering layer is low, the moisture does not excessively adsorb to the surface of the covering layer, and accordingly the fluctuation of the light portion potential during the repeated use can be reduced in the high temperature and high humidity environment.

In the high temperature and high humidity environment, the content of the niobium element or the tantalum element is more preferably 0.1 atomic % or less of the metal elements contained in the above described covering layer, and further preferably the covering layer does not contain the niobium element or the tantalum element.

In the present disclosure, as the core material of the metal oxide particles, one having any of various shapes such as a spherical shape, a polyhedral shape, an ellipsoidal shape, a flake shape and a needle shape can be used. Among the shapes, a core material of a spherical shape, a polyhedral shape and an ellipsoidal shape are preferably used, from the viewpoint of less causing in image defects such as a black spot. Furthermore, the core material more preferably has a spherical shape or a polyhedral shape close to a spherical shape.

In the present disclosure, the core material of the metal oxide particle preferably contains an anatase type titanium oxide or a rutile type titanium oxide. Furthermore, the core material more preferably contains the anatase type titanium oxide, and particularly preferably consists of the anatase type titanium oxide. By employing the anatase type titanium oxide, the fluctuation of the light portion potential becomes more unlikely to occur.

In the present disclosure, the average primary particle size of the metal oxide particles is preferably 50 nm or more and 500 nm or less. When the average primary particle size of the metal oxide particles is 50 nm or more, the particle hardly re-aggregates after preparation of a coating liquid for an electroconductive layer. If the particle re-aggregates, deterioration in stability of a coating liquid for an electroconductive layer and/or the occurrence of cracking on the surface of an electroconductive layer to be formed are easily caused. When the average primary particle size of the metal oxide particles is 500 nm or less, the surface of the electroconductive layer is hardly roughened. If the surface of the electroconductive layer is roughened, local charge injection to the photosensitive layer easily occurs and a black point (black spot) on the white background of an output image is easily noticeable. Furthermore, in the present disclosure, an average primary particle size of the metal oxide particles is more preferably 100 nm or more and 400 nm or less.

In the present disclosure, the average primary particle size $D_1$ of the metal oxide particles is determined by using a scanning-type electron microscope as follows. An S-4800 scanning-type electron microscope manufactured by Hitachi Ltd. is used to observe a particle to be measured, the respective particle sizes of 100 of the particles in an image obtained by such observation are measured, and the arithmetic average thereof is calculated and defined as the average primary particle size $D_1$. The respective particle sizes are obtained as (a+b)/2 where the longest side and the shortest side of a primary particle are defined as a and b, respectively. Herein, in the case of the needle-shaped metal oxide particles or the flake-shaped metal oxide particles, the average particle sizes have been calculated for the major axis diameter and the minor axis diameter, respectively.

In addition, in the present disclosure, the average primary particle size of the core material is preferably 1 to 50 times the average layer thickness of the covering layer, and more preferably 5 to 20 times. Due to the average primary particle size being within such a range, the resolution of the latent image becomes further adequate. In addition, the average layer thickness of the covering layer is more preferably 5 nm or more.

In the present disclosure, the surface of the metal oxide particle may be treated with a silane coupling agent or the like.

In the present disclosure, the content of the metal oxide particle preferably accounts for 20% by volume or more and 50% by volume or less of the total volume of the electroconductive layer. When the content of the metal oxide particle is 20% by volume or more, the distance between the particles becomes short, the volume resistivity of the electroconductive layer is apt to become low, and when the content of the metal oxide particle is 50% by volume or less, the distance between the particles becomes long, and a portion at which the particles are in contact with each other resists being formed. Accordingly, because it becomes difficult for the particles to come in contact with each other, the volume resistivity of the electroconductive layer does not become locally low, and accordingly a leak resists occurring in the electrophotographic photosensitive member. Furthermore, the content of the metal oxide particle more preferably accounts for 30% by volume or more and 45% by volume or less of the total volume of the electroconductive layer.

The electroconductive layer of the present disclosure may contain another electroconductive particle in addition to the above described metal oxide particle. Examples of the material of such other electroconductive particle include a metal oxide, a metal and carbon black. Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, nichrome, copper, zinc and silver.

When the metal oxide is used in such other electroconductive particle, the surface of the metal oxide may be treated with a silane coupling agent or the like, or the metal oxide may also be doped with an element such as phosphorus or aluminum, or an oxide thereof.

Such other electroconductive particle may have a layered configuration having a core material and a covering layer with which the core material is covered. Examples of the core material include titanium oxide, barium sulfate and zinc oxide particles. Examples of the covering layer include a metal oxide such as tin oxide.

When a metal oxide is used as the electroconductive particle other than the titanium oxide of the present disclosure, the volume average particle size is preferably 1 nm or more and 500 nm or less, and more preferably 3 nm or more and 400 nm or less.

Binder materials include a polyester resin, a polycarbonate resin, a polyvinyl acetal resin, an acrylic resin, a silicone resin, an epoxy resin, a melamine resin, a polyurethane resin, a phenol resin and an alkyd resin.

The electroconductive layer may also further contain a silicone oil, a resin particle and the like.

The electroconductive layer may further contain an electron-accepting substance. By containing the electron-accepting substance, the fluctuation of the light portion potential during the repeated use can be further reduced.

The electron-accepting substances include a quinone compound, an anthraquinone compound, a phthalocyanine compound, a porphyrin compound and a triphenylmethane compound.

The electroconductive layer may further contain an additive such as a salicylic acid derivative.

The average thickness of the electroconductive layer is preferably 0.5 μm or more and 50 μm or less, more preferably 1 μm or more and 40 μm or less, particularly preferably 5 μm or more and 35 μm or less.

In the present disclosure, luminosity means the luminosity L* in the L*a*b* color system (CIE: 1976). The luminosity of the metal oxide particle of the present disclosure and the luminosity of the electroconductive layer can be measured with a spectral densitometer, a spectrocolorimeter or the like.

In the present disclosure, the luminosity L* in the L*a*b* color system (CIE: 1976) has been measured with the use of a spectral densitometer (X-Rite 939, manufactured by X-Rite Incorporated).

In the present disclosure, the luminosity of the metal oxide particle is preferably 60 or more. When the luminosity of the metal oxide particle is 60 or more, it becomes easy to control the luminosity of the electroconductive layer to 60 or more. In order to increase the luminosity of the electroconductive layer, the luminosity of the metal oxide particle is more preferably 70 or more, and the luminosity of the metal oxide particle is further preferably 80 or more.

In the present disclosure, the luminosity of the electroconductive layer is preferably 60 or more. When the luminosity of the electroconductive layer is 60 or more, an electrophotographic photosensitive member having an adequately high initial sensitivity can be obtained. In order to obtain further adequately high initial sensitivity, the luminosity of the electroconductive layer is preferably 70 or more, and the luminosity of the electroconductive layer is further preferably 80 or more.

There is a correlation between the electroconductive performance and the luminosity of the titanium oxide particle, and accordingly by designing the particle so as to have as high luminosity as possible in a range in which a necessary electroconductive performance can be obtained, an adequately high initial sensitivity and the electroconductive performance can be simultaneously achieved at a high level.

In the present disclosure, the volume resistivity of the electroconductive layer is preferably $1.0\times10^{8}$ Ω·cm or more and $1.0\times10^{13}$ Ω·cm or less. When the volume resistivity of the electroconductive layer is $1.0\times10^{13}$ Ω·cm or less, charge flow is hardly disrupted during image formation, the residual potential is hardly increased, and a variation in light portion potential is hardly caused. On the other hand, when the volume resistivity of the electroconductive layer is $1.0\times10^{8}$ Ω·cm or more, the amount of a charge which flows into the electroconductive layer during charging of the electrophotographic photosensitive member is hardly too large, and leakage hardly occurs. Furthermore, the volume resistivity of the electroconductive layer is more preferably $1.0\times10^{8}$ Ω·cm or more and $1.0\times10^{12}$ Ω·cm or less.

Figure 2:
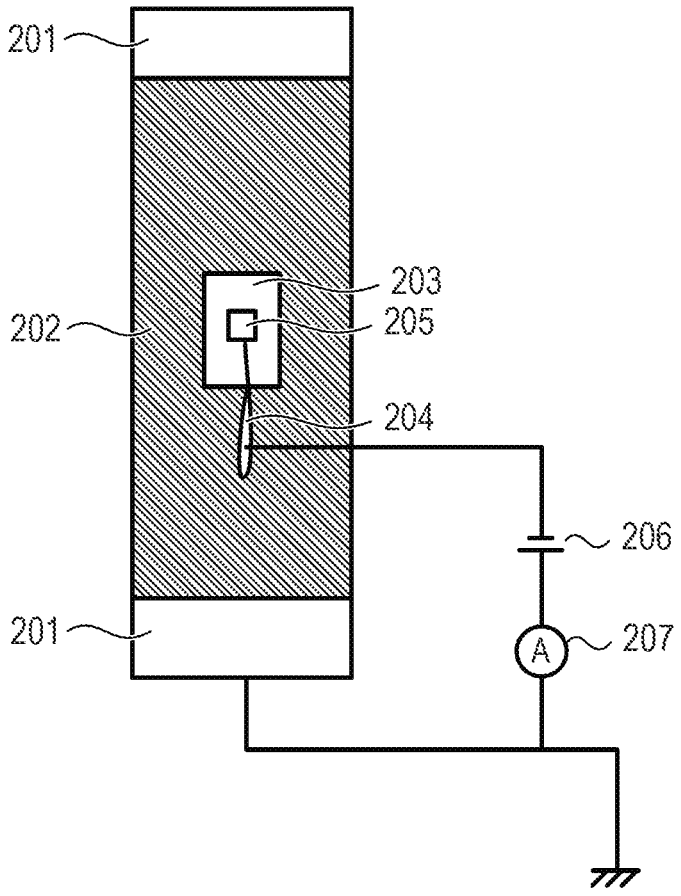
FIG. 2 is a top view for describing a method for measuring the volume resistivity of an electroconductive layer.
Figure 3:
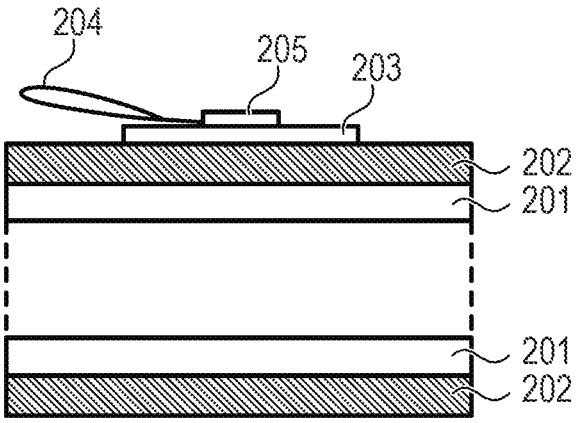
FIG. 3 is a cross sectional view for describing the method for measuring the volume resistivity of an electroconductive layer.

The method for measuring the volume resistivity of the electroconductive layer of the electrophotographic photosensitive member is described with reference to FIG. 2 and FIG. 3. FIG. 2 is a top view for describing the method for measuring the volume resistivity of the electroconductive layer, and FIG. 3 is a cross sectional view for describing the method for measuring the volume resistivity of the electroconductive layer.

The volume resistivity of the electroconductive layer is measured under a normal temperature and normal humidity (temperature 23° C./relative humidity 50%) environment. A copper tape 203 (Model No. 1181 produced by Sumitomo 3M Limited) is pasted onto the surface of an electroconductive layer 202, and used as an electrode closer to the front surface of the electroconductive layer 202. In addition, a support 201 is used as an electrode closer to the rear surface of the electroconductive layer 202. A power source 206 that applies a voltage between the copper tape 203 and the support 201, and current measurement equipment 207 that measures a current flowing between the copper tape 203 and the support 201 are each disposed. In addition, in order to apply a voltage to a copper-made tape 203, a copper wire 204 is placed on the copper-made tape 203, and a copper-made tape 205 similar to the copper-made tape 203 is stuck from above the copper wire 204 so that the copper wire 204 is not detached from the copper-made tape 203, and the copper wire 204 is fixed to the copper-made tape 203. A voltage is applied to the copper tape 203 by use of the copper wire 204.

When the background current value with no voltage applied between the copper tape 203 and the support 201 is designated as $I_0$ (A), the current value with application of a voltage of −1 V, which is only a DC voltage (DC component), is designated as I (A), the film thickness of the electroconductive layer 202 is designated as d (cm), and the area of the electrode (copper-made tape 203) on a side of the surface of the electroconductive layer 202 is designated as S ($cm^2$), the value calculated by Expression ($\rho=1/(I-I_0)\times S/d$) is defined as the volume resistivity ρ (Ω·cm) of the electroconductive layer 202.

A trace amount of current of $1\times10^{-6}$ A or less, as an absolute value, is measured in the measurement, and therefore the measurement can be performed by use of equipment that can measure a trace amount of current as the current measurement equipment 207. Examples of such equipment include a 4140B pA meter manufactured by Yokogawa-Hewlett-Packard Company. Herein, the volume resistivity of the electroconductive layer is represented as the same value even when measured in the state where only the electroconductive layer is formed on the support, and even when measured in the state where only the electroconductive layer remains on the support by peeling off of respective layers (photosensitive layer and the like) on the electroconductive layer from the electrophotographic photosensitive member.

In the present disclosure, the volume resistivity (powder resistivity) as powders of the particles is preferably $1.0\times10^{1}$ Ω·cm or more and $1.0\times10^{6}$ Ω·cm or less. When the powder resistivity is in this range, it becomes easy to obtain an electroconductive layer of which the above described preferable volume resistivity becomes within the above described preferable range. Furthermore, the powder resistivity of the particles is more preferably $1.0\times10^{2}$ Ω·cm or more and $1.0\times10^{5}$ Ω·cm or less. Herein, in the present disclosure, the powder resistivity of the particles is measured under a normal temperature and a normal humidity (temperature 23° C./relative humidity 50%) environment. In the present disclosure, a resistivity meter Loresta GP manufactured by Mitsubishi Chemical Corporation has been used as a measuring apparatus. The particles of the present disclosure, which are a measuring object, have been solidified at a pressure of 500 $kg/cm^2$ and thus formed into a pellet-shaped measurement sample, and the applied voltage has been set at 100 V.

The electroconductive layer can be formed by preparing a coating liquid for the electroconductive layer, which contains each of the above described materials and a solvent, forming a coating film of the coating liquid, and drying the coating film. The solvents to be used in the coating liquid include an alcohol-based solvent, a sulfoxide-based solvent, a ketone-based solvent, an ether-based solvent, an ester-based solvent and an aromatic hydrocarbon-based solvent.

Methods for dispersing the electroconductive particle in the coating liquid for an electroconductive layer include methods with the use of a paint shaker, a sand mill, a ball mill and a liquid collision type high-speed dispersing machine. The coating liquid for the electroconductive layer, prepared by dispersion, may be filtered to remove unnecessary components as the coating liquid for the electroconductive layer.

<Undercoat Layer>

In the present disclosure, an undercoat layer may also be provided on the electroconductive layer. The undercoat layer can be provided to thereby increase an adhesion function between layers and impart a function of inhibiting charge injection.

The undercoat layer can contain a resin. The undercoat layer may also be formed as a cured film by polymerization of a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinylphenol resin, an alkyd resin, a polyvinyl alcohol resin, a polyethylene oxide resin, a polypropylene oxide resin, a polyamide resin, a polyamide acid resin, a polyimide resin, a polyamideimide resin and a cellulose resin.

With respect to the monomer having a polymerizable functional group, examples of the polymerizable functional group include an isocyanate group, a block isocyanate group, a methylol group, an alkylated methylol group, an epoxy group, a metal alkoxide group, a hydroxyl group, an amino group, a carboxyl group, a thiol group, a carboxylic anhydride group and a carbon-carbon double bond group.

The undercoat layer may also further contain an electron transport material, a metal oxide, a metal, an electroconductive polymer and the like in order to enhance electrical characteristics. In particular, an electron transport material or a metal oxide can be used.

Examples of the electron transport material include a quinone compound, an imide compound, a benzoimidazole compound, a cyclopentadienylidene compound, a fluorenone compound, a xanthone compound, a benzophenone compound, a cyanovinyl compound, a halogenated aryl compound, a silole compound and a boron-containing compound. The undercoat layer may also be formed as a cured film obtained by using, as the electron transport material, an electron transport material having a polymerizable functional group, and copolymerizing the electron transport material with the monomer having a polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

The undercoat layer may also further contain an additive.

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer can be formed by preparing a coating liquid for an undercoat layer, the coating liquid containing the above respective materials and solvent, and drying and/or curing a coating film of the coating liquid. Examples of the solvent for use in the coating liquid include an alcohol-based solvent, a ketone-based solvent, an ether-based solvent, an ester-based solvent and an aromatic hydrocarbon-based solvent.

<Photosensitive Layer>

The photosensitive layer of the electrophotographic photosensitive member is mainly classified to a layered type photosensitive layer (1) and a monolayer type photosensitive layer (2). The layered type photosensitive layer (1) includes a charge generation layer containing a charge generation material and a charge transport layer containing a charge transport material. The monolayer type photosensitive layer (2) includes a photosensitive layer containing both of a charge generation material and a charge transport material.

Layered Type Photosensitive Layer (1)

The layered type photosensitive layer includes a charge generation layer and a charge transport layer.

Charge Generation Layer (1-1)

The charge generation layer can contain a charge generation material and a resin.

Examples of the charge generation material include an azo pigment, a perylene pigment, a polycyclic quinone pigment, an indigo pigment and a phthalocyanine pigment. In particular, an azo pigment or a phthalocyanine pigment can be adopted. As the phthalocyanine pigment, an oxytitanium phthalocyanine pigment, a chlorogallium phthalocyanine pigment or a hydroxygallium phthalocyanine pigment can be adopted.

The content of the charge generation material in the charge generation layer is preferably 40% by mass or more and 85% by mass or less, more preferably 60% by mass or more and 80% by mass or less based on the total mass of the charge generation layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. In particular, a polyvinyl butyral resin is more preferable.

The charge generation layer may also further contain additives such as an antioxidant and an ultraviolet absorber. Specific examples include a hindered phenol compound, a hindered amine compound, a sulfur compound, a phosphorus compound and a benzophenone compound.

The average thickness of the charge generation layer is preferably 0.1 μm or more and 1 μm or less, more preferably 0.15 μm or more and 0.4 μm or less.

The charge generation layer can be formed by preparing a coating liquid for a charge generation layer, the coating liquid containing the above respective materials and solvent, and forming a coating film of the coating liquid and drying the coating film. Examples of the solvent for use in the coating liquid include an alcohol-based solvent, a sulfoxide-based solvent, a ketone-based solvent, an ether-based solvent, an ester-based solvent and an aromatic hydrocarbon-based solvent.

Charge Transport Layer (1-2)

The charge transport layer can contain a charge transport material and a resin.

Examples of the charge transport material include a polycyclic aromatic compound, a heterocyclic compound, a hydrazone compound, a styryl compound, an enamine compound, a benzidine compound, a triarylamine compound and a resin having a group derived from such a material. In particular, a triarylamine compound or a benzidine compound can be adopted.

The content of the charge transport material in the charge transport layer is preferably 25% by mass or more and 70% by mass or less, more preferably 30% by mass or more and 55% by mass or less based on the total mass of the charge transport layer.

Examples of the resin include a polyester resin, a polycarbonate resin, an acrylic resin and a polystyrene resin. In particular, a polycarbonate resin or a polyester resin can be adopted. As the polyester resin, a polyarylate resin can be particularly adopted.

The content ratio (mass ratio) of the charge transport material and the resin is preferably 4:10 to 20:10, more preferably 5:10 to 12:10.

The charge transport layer may also contain additives such as an antioxidant, an ultraviolet absorber, a plasticizer, a leveling agent, a slipperiness imparter and a wear resistance improver. Specific examples include a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle and a boron nitride particle.

The average thickness of the charge transport layer is preferably 5 μm or more and 50 μm or less, more preferably 8 μm or more and 40 μm or less, particularly preferably 9 μm or more and 30 μm or less.

The charge transport layer can be formed by preparing a coating liquid for a charge transport layer, the coating liquid containing the above respective materials and solvent, and forming a coating film of the coating liquid and drying the coating film. Examples of the solvent for use in the coating liquid include an alcohol-based solvent, a ketone-based solvent, an ether-based solvent, an ester-based solvent and an aromatic hydrocarbon-based solvent. As such a solvent, an ether-based solvent or an aromatic hydrocarbon-based solvent can be adopted.

Monolayer Type Photosensitive Layer (2)

The monolayer type photosensitive layer can be formed by preparing a coating liquid for a photosensitive layer, the coating liquid containing a charge generation material, a charge transport material, a resin and a solvent, forming a coating film of the coating liquid and drying the coating film. Examples of the charge generation material, the charge transport material and the resin are the same as the materials exemplified in the "layered type photosensitive layer (1)".

<Protection Layer>

In the present disclosure, a protection layer may also be provided on the photosensitive layer. The protection layer can be provided to thereby enhance durability.

The protection layer can contain an electroconductive particle and/or a charge transport material, and a resin. Examples of the electroconductive particle include particles of metal oxides such as titanium oxide, zinc oxide, tin oxide and indium oxide.

Examples of the charge transport material include a polycyclic aromatic compound, a heterocyclic compound, a hydrazone compound, a styryl compound, an enamine compound, a benzidine compound, a triarylamine compound and a resin having a group derived from such a material. In particular, a triarylamine compound or a benzidine compound can be adopted.

Examples of the resin include a polyester resin, an acrylic resin, a phenoxy resin, a polycarbonate resin, a polystyrene resin, a phenol resin, a melamine resin and an epoxy resin. In particular, a polycarbonate resin, a polyester resin or an acrylic resin can be adopted.

The protection layer may also be formed as a cured film by polymerization of a composition containing a monomer having a polymerizable functional group. Examples of the reaction here include a thermal polymerization reaction, a photopolymerization reaction and a radiation polymerization reaction. With respect to the monomer having a polymerizable functional group, examples of the polymerizable functional group include an acrylic group and a methacrylic group. A material having charge transport ability may also be used as the monomer having a polymerizable functional group.

The protection layer may also contain additives such as an antioxidant, an ultraviolet absorber, a plasticizer, a leveling agent, a slipperiness imparter and a wear resistance improver. Specific examples include a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle and a boron nitride particle.

The average thickness of the protection layer is preferably 0.5 μm or more and 10 μm or less, preferably 1 μm or more and 7 μm or less.

The protection layer can be formed by preparing a coating liquid for a protection layer, the coating liquid containing the above respective materials and solvent, forming a coating film of the coating liquid, and drying and/or curing the coating film. Examples of the solvent for use in the coating liquid include an alcohol-based solvent, a ketone-based solvent, an ether-based solvent, a sulfoxide-based solvent, an ester-based solvent and an aromatic hydrocarbon-based solvent.

[Process Cartridge and Electrophotographic Apparatus]

The process cartridge of the present disclosure integrally supports the above-mentioned electrophotographic photosensitive member, and at least one unit selected from a charging unit, a developing unit, a transfer unit and a cleaning unit, and is detachably mountable on a main body of an electrophotographic apparatus.

The electrophotographic apparatus of the present disclosure includes the above-mentioned electrophotographic photosensitive member, a charging unit, an exposure unit, a developing unit and a transfer unit.

FIG. 1 illustrates one example of a schematic configuration of an electrophotographic apparatus including a process cartridge including an electrophotographic photosensitive member.

Reference numeral 1 represents a cylindrical electrophotographic photosensitive member, and is rotatably driven at a predetermined circumferential velocity in an arrow direction around an axis 2. The surface of the electrophotographic photosensitive member 1 is charged at a predetermined positive or negative potential by a charging unit 3. While a roller charging system by a roller type charging member is illustrated in FIG. 1, any charging system such as a corona charging system, a close charging system or an injection charging system may also be adopted. The surface of the electrophotographic photosensitive member 1 charged is irradiated with exposure light 4 from an exposure unit (not illustrated), and an electrostatic latent image corresponding to objective image information is formed. The electrostatic latent image formed on the surface of the electrophotographic photosensitive member 1 is developed by a toner accommodated in a developing unit 5, and a toner image is formed on the surface of the electrophotographic photosensitive member 1. The toner image formed on the surface of the electrophotographic photosensitive member 1 is transferred to a transfer material 7 by a transfer unit 6. The transfer material 7 to which the toner image is transferred is conveyed to a fixing unit 8, subjected to a fixing treatment of the toner image and discharged to the outside of the electrophotographic apparatus. The electrophotographic apparatus may include a cleaning unit 9 for removal of any attached material such as a toner remaining on the surface of the electrophotographic photosensitive member 1 after transferring. A so-called cleanerless system that removes the attached material by a developing unit or the like with no cleaning unit being separately provided may also be used. The electrophotographic apparatus may include a neutralization mechanism that performs a neutralization treatment of the surface of the electrophotographic photosensitive member 1 with pre-exposure light 10 from a pre-exposure unit (not illustrated). A guiding unit 12 such as a rail may also be provided in order to detachably mount a process cartridge 11 of the present disclosure on the main body of the electrophotographic apparatus.

The electrophotographic photosensitive member of the present disclosure can be used for a laser beam printer, an LED printer, a copier, a facsimile and a combined machine.

EXAMPLES

Hereinafter, the present disclosure will be described in more detail with reference to Examples and Comparative Examples. The present disclosure is not limited to the following Examples at all without departing from the gist thereof. Herein, the term "parts" in the following description of Examples means parts by mass unless otherwise particularly noted.

[Production of Metal Oxide Particle]

(Metal Oxide Particle 1)

Titanium dioxide of the core material can be produced by a known sulfuric acid method. That is, the titanium dioxide is obtained by heating and hydrolyzing a solution containing titanium sulfate and titanyl sulfate to produce a metatitanic acid slurry, and dehydrating and calcining the metatitanic acid slurry.

As the core particles, anatase type titanium oxide particles having an average primary particle size of 200 nm were employed. A titanium niobium sulfate solution containing 33.7 g of titanium in terms of $TiO_2$ and 2.9 g of niobium in terms of $Nb_2O_5$ was prepared. In pure water, 100 g of the core particles were dispersed to prepare 1 L of a suspension liquid, and the suspension liquid was heated to 60° C. The titanium niobium sulfate solution and a 10 mol/L solution of sodium hydroxide were added dropwise to the suspension liquid over 3 hours so that the pH of the suspension liquid became 2 to 3. After the whole quantity was added dropwise, the pH was adjusted to the vicinity of neutrality, and a flocculant was added to precipitate a solid content. The supernatant was removed, the rest was filtered, and the residue was washed and then dried at 110° C. to obtain an intermediate body containing 0.1 wt % in terms of C of an organic substance derived from the flocculant. The intermediate body was calcined at 800° C. in nitrogen gas for 1 hour to produce a metal oxide particle 1.

(Metal Oxide Particles 2 to 23 and C1 to C8)

Powders of metal oxide particles 2 to 23 and C1 to C8 were obtained in the same manner as in the metal oxide particle 1 as shown in Table 1, except that the employed core material and condition at the time of covering in the production of the metal oxide particle 1 were changed as shown in Table 1.

TABLE 1

| | Core particle | | | Covering layer | | | Whole particle | | | | |
|---|---|---|---|---|---|---|---|---|---|---|---|
| Metal oxide particle No. | Crystal form of core material | Average primary particle size of core material (nm) | Titanium element among metal elements contained in core material (atomic %) | Doped species in covering layer | Doped element among metal elements contained in covering layer (atomic %) | Average layer thickness thickness of covering layer (nm) | Titanium element among metal elements contained in whole particle (atomic %) | Powder resistivity (Ω· cm) | Luminosity | Oxygen deficiency ratio A of particle (%) | Oxygen deficiency ratio C of covering layer/ oxygen deficiency ratio B of core material |
| Metal oxide particle 1 | Anatase type | 200 | >99 | Niobium | 2.7 | 20 | 98 | $1 \times 10^4$ | 70 | 0.5 | 25 |
| Metal oxide particle 2 | Anatase type | 200 | >99 | Niobium | 2.7 | 20 | 98 | $3 \times 10^3$ | 60 | 1 | 40 |
| Metal oxide particle 3 | Anatase type | 200 | >99 | Niobium | 2.7 | 20 | 98 | $5 \times 10^4$ | 80 | 0.3 | 17 |
| Metal oxide particle 4 | Anatase type | 200 | >99 | Niobium | 2.7 | 20 | 98 | $5 \times 10^5$ | 90 | 0.03 | 12 |
| Metal oxide particle 5 | Anatase type | 200 | >99 | Niobium | 2.7 | 20 | 98 | $5 \times 10^3$ | 50 | 2 | 60 |
| Metal oxide particle 6 | Anatase type | 300 | >99 | Niobium | 4.4 | 20 | 98 | $7 \times 10^3$ | 80 | 0.5 | 17 |
| Metal oxide particle 7 | Anatase type | 100 | >99 | Niobium | 1.1 | 20 | 98 | $3 \times 10^5$ | 65 | 0.8 | 30 |
| Metal oxide particle 8 | Anatase type | 200 | >99 | Niobium | 1.1 | 40 | 98 | $5 \times 10^3$ | 65 | 0.7 | 30 |
| Metal oxide particle 9 | Anatase type | 100 | >99 | Niobium | 0.1 | 100 | 98 | $2 \times 10^3$ | 60 | 1 | 20 |
| Metal oxide particle 10 | Anatase type | 100 | >99 | Niobium | 0.1 | 120 | 98 | $1 \times 10^3$ | 55 | 1.5 | 10 |
| Metal oxide particle 11 | Anatase type | 200 | >99 | Niobium | 6.0 | 10 | 98 | $1 \times 10^6$ | 70 | 0.5 | 50 |
| Metal oxide particle 12 | Anatase type | 200 | >99 | Niobium | 16.0 | 4 | 98 | $5 \times 10^6$ | 80 | 0.3 | 30 |

TABLE 1-continued

| | Core particle | | | Covering layer | | | Whole particle | | | | |
|---|---|---|---|---|---|---|---|---|---|---|---|
| Metal oxide particle No. | Crystal form of core material | Average primary particle size of core material (nm) | Titanium element among metal elements contained in core material (atomic %) | Doped species in covering layer | Doped element among metal elements contained in covering layer (atomic %) | Average layer thickness thickness of covering layer (nm) | Titanium element among metal elements contained in whole particle (atomic %) | Powder resistivity (Ω· cm) | Luminosity | Oxygen deficiency ratio A of particle (%) | Oxygen deficiency ratio C of covering layer/ oxygen deficiency ratio B of core material |
| Metal oxide particle 13 | Anatase type | 200 | >99 | Niobium | 32.7 | 2 | 98 | $2 \times 10^7$ | 90 | 0.03 | 20 |
| Metal oxide particle 14 | Anatase type | 200 | 98 | Niobium | 13.7 | 20 | 90 | $2 \times 10^5$ | 65 | 0.7 | 30 |
| Metal oxide particle 15 | Anatase type | 200 | 95 | Niobium | 20.6 | 20 | 85 | $1 \times 10^5$ | 60 | 1 | 40 |
| Metal oxide particle 16 | Anatase type | 200 | >99 | — | — | 20 | >99 | $5 \times 10^7$ | 75 | 0.4 | 20 |
| Metal oxide particle 17 | Anatase type | 200 | >99 | Niobium | 13.7 | 20 | 90 | $1 \times 10^5$ | 70 | 0.5 | 25 |
| Metal oxide particle 18 | Anatase type | 200 | >99 | Niobium | 27.5 | 20 | 80 | $3 \times 10^4$ | 65 | 0.7 | 30 |
| Metal oxide particle 19 | Anatase type | 200 | >99 | Tantalum | 2.7 | 20 | 98 | $1 \times 10^4$ | 70 | 0.5 | 25 |
| Metal oxide particle 20 | Rutile type | 200 | >99 | Niobium | 2.7 | 20 | 98 | $1 \times 10^4$ | 70 | 0.5 | 25 |
| Metal oxide particle 21 | Anatase type | 200 | >99 | Niobium | 0.5 | 20 | >99 | $5 \times 10^4$ | 70 | 0.5 | 25 |
| Metal oxide particle 22 | Anatase type | 200 | >99 | Niobium | 0.2 | 20 | >99 | $1 \times 10^5$ | 70 | 0.5 | 25 |
| Metal oxide particle 23 | Anatase type | 200 | >99 | Niobium | 0.1 | 20 | >99 | $1 \times 10^6$ | 70 | 0.5 | 25 |
| Metal oxide particle C1 | Anatase type | 200 | >99 | — | — | 20 | >99 | $1 \times 10^1$ | 20 | 30 | — |
| Metal oxide particle C2 | Anatase type | 200 | >99 | — | — | 20 | >99 | $1 \times 10^5$ | 70 | 5 | — |
| Metal oxide particle C3 | Anatase type | 200 | >99 | — | — | 20 | >99 | $1 \times 10^7$ | 90 | 1 | — |
| Metal oxide particle C4 | Anatase type | 200 | >99 | Niobium | 2.7 | 20 | 98 | $1 \times 10^5$ | 70 | 5 | 1 |
| Metal oxide particle C5 | Anatase type | 200 | >99 | Niobium | 2.7 | 20 | 98 | $5 \times 10^2$ | 50 | 15 | 1 |
| Metal oxide particle C6 | Anatase type | 200 | >99 | Niobium | 2.7 | 20 | 98 | $1 \times 10^2$ | 40 | 20 | 15 |
| Metal oxide particle C7 | Anatase type | 200 | >99 | — | — | 20 | >99 | $1 \times 10^6$ | 70 | 5 | 1 |
| Metal oxide particle C8 | Anatase type | 200 | >99 | — | — | 20 | >99 | $1 \times 10^3$ | 50 | 15 | 1 |

[Preparation of Coating Liquid for Electroconductive Layer]

(Coating Liquid 1 for Electroconductive Layer)

A phenolic resin (phenolic resin monomer/oligomer) (trade name: Plyophene J-325, produced by DIC Corporation, resin solid content: 60%, and density after curing: 1.3 g/cm$^2$) of a binder material in an amount of 80 parts was dissolved in 60 parts of 1-methoxy-2-propanol of a solvent to obtain the solution.

The metal oxide particle 1 (100 parts) was added to the solution, and the resultant was used as a dispersion medium and placed in a vertical sand mill using 200 parts of glass beads having an average particle size of 1.0 mm, and subjected to a dispersion treatment in conditions of a dispersion liquid temperature of 23±3° C. and a number of rotations of 1500 rpm (circumferential velocity: 5.5 m/s) for 2 hours, thereby providing a dispersion liquid. The glass beads were removed from the dispersion liquid by a mesh. The dispersion liquid from which the glass beads were removed was subjected to filtration under pressure by use of PTFE filter paper (trade name: PF060, produced by Advantec Toyo Kaisha, Ltd.). Into the dispersion liquid after the pressure filtration, 0.015 parts of silicone oil (trade name: SH28 PAINT ADDITIVE, produced by Dow Corning Toray Co. Ltd.) as a leveling agent, and 15 parts of silicone resin particles (trade name: KMP-590, produced by Shin-Etsu Chemical Co., Ltd., average particle size: 2 μm, and density: 1.3 g/cm$^3$) as a surface roughness imparting material were added, the mixture was stirred, and thereby a coating liquid 1 for the electroconductive layer was prepared.

(Coating Liquids 2 to 18, 23 to 26, 28, 30 to 32 and C1 to C8 for Electroconductive Layer)

Each of coating liquids 2 to 18, 23 to 26, 28, 30 to 32 and C1 to C8 for an electroconductive layer was prepared by the same operation as in preparation of coating liquid 1 for an electroconductive layer except that the type and the amount (number of parts) of the metal oxide particle for use in preparation of the coating liquid 1 for an electroconductive layer were as shown in Table 2.

(Coating liquid 19 for electroconductive layer)

A coating liquid 19 for the electroconductive layer was prepared in the same operation as in the preparation of the coating liquid 1 for the electroconductive layer, except that the dispersion treatment was performed for 1 hour under the condition of a rotation number of 1,000 rpm, when the coating liquid 1 for the electroconductive layer was prepared.

(Coating Liquid 20 for Electroconductive Layer)

A coating liquid 20 for the electroconductive layer was prepared in the same operation as in the preparation of the coating liquid 1 for the electroconductive layer, except that the dispersion treatment was performed for 3 hour under the condition of a rotation number of 2,000 rpm, when the coating liquid 1 for the electroconductive layer was prepared.

(Coating Liquid 21 for Electroconductive Layer)

A coating liquid 21 for the electroconductive layer was prepared in the same operation as in the preparation of the coating liquid 1 for the electroconductive layer, except that the dispersion treatment was performed for 6 hour under the condition of a rotation number of 2,000 rpm, when the coating liquid 1 for the electroconductive layer was prepared.

(Coating Liquid 22 for Electroconductive Layer)

A coating liquid 22 for the electroconductive layer was prepared in the same operation as in the preparation of the coating liquid 1 for the electroconductive layer, except that the dispersion treatment was performed for 10 hour under the condition of a rotation number of 2,000 rpm, when the coating liquid 1 for the electroconductive layer was prepared.

(Coating Liquid 27 for Electroconductive Layer)

A coating liquid 27 for the electroconductive layer was prepared in the same operation as in the preparation of the coating liquid 1 for the electroconductive layer, except that the surface roughness imparting material was not added when the coating liquid 1 for the electroconductive layer was prepared.

(Coating Liquid 29 for Electroconductive Layer)

A butyral resin (15 parts) (trade name: BM-1, produced by Sekisui Chemical Co., Ltd.) as a binder material and 15 parts of a blocked isocyanate resin (trade name: TPA-B80E, 80% solution, produced by Asahi Kasei Corporation) were dissolved in a mixed solvent of 45 parts of methyl ethyl ketone/85 parts of 1-butanol, thereby providing a solution. The metal oxide particle 1 (70 parts) was added to the solution, and the resultant was used as a dispersion medium and placed in a vertical sand mill using 120 parts of glass beads having an average particle size of 1.0 mm, and subjected to a dispersion treatment in conditions of a dispersion liquid temperature of 23±3° C. and a number of rotations of 1500 rpm (circumferential velocity: 5.5 m/s) for 4 hours, thereby providing a dispersion liquid. The glass beads were removed from the dispersion liquid by a mesh. The dispersion liquid from which the glass beads were removed was subjected to filtration under pressure by use of PTFE filter paper (trade name: PF060, produced by Advantec Toyo Kaisha, Ltd.). Into the dispersion liquid after the pressure filtration, 0.015 parts of silicone oil (trade name: SH28 PAINT ADDITIVE, produced by Dow Corning Toray Co., Ltd.) as the leveling agent, and 5 parts of particles of a crosslinking type of polymethyl methacrylate (PMMA) (trade name: Techpolymer SSX-102, produced by Sekisui Plastics Co. Ltd., average primary particle size: 2.5 μm, and density: 1.2 g/cm$^2$) as the surface roughness imparting material were added, the mixture was stirred, and thereby a coating liquid 29 for the electroconductive layer was prepared.

(Coating Liquid 33 for Electroconductive Layer)

A coating liquid 33 for the electroconductive layer was prepared in the same operation as in the preparation of the coating liquid 29 for the electroconductive layer, except that the type of the metal oxide particle employed when the coating liquid 29 for the electroconductive layer was prepared was changed to a metal oxide particle 16.

(Coating Liquid 34 for Electroconductive Layer)

A coating liquid 34 for the electroconductive layer was prepared in the same operation as in the preparation of the coating liquid 29 for the electroconductive layer, except that 1 part of alizarin (produced by TOKYO CHEMICAL INDUSTRY CO., LTD.) was added together with the metal oxide particle 16 when the coating liquid 33 for the electroconductive layer was prepared.

(Coating Liquid 35 for Electroconductive Layer)

A coating liquid 35 for the electroconductive layer was prepared in the same operation as in the preparation of the coating liquid 29 for the electroconductive layer, except that 1 part of 2-hydroxybenzoic acid (produced by TOKYO CHEMICAL INDUSTRY CO., LTD.) was added together with the metal oxide particle 16 when the coating liquid 33 for the electroconductive layer was prepared.

TABLE 2

| Coating liquid for electroconductive layer No. | Metal oxide particle No. | Amount of particle used (parts) |
|---|---|---|
| Coating liquid for electroconductive layer 1 | Metal oxide particle 1 | 100 |
| Coating liquid for electroconductive layer 2 | Metal oxide particle 2 | 100 |
| Coating liquid for electroconductive layer 3 | Metal oxide particle 3 | 100 |
| Coating liquid for electroconductive layer 4 | Metal oxide particle 4 | 100 |
| Coating liquid for electroconductive layer 5 | Metal oxide particle 5 | 100 |
| Coating liquid for electroconductive layer 6 | Metal oxide particle 6 | 100 |
| Coating liquid for electroconductive layer 7 | Metal oxide particle 7 | 100 |
| Coating liquid for electroconductive layer 8 | Metal oxide particle 8 | 100 |
| Coating liquid for electroconductive layer 9 | Metal oxide particle 9 | 100 |
| Coating liquid for electroconductive layer 10 | Metal oxide particle 10 | 100 |
| Coating liquid for electroconductive layer 11 | Metal oxide particle 11 | 100 |
| Coating liquid for electroconductive layer 12 | Metal oxide particle 12 | 100 |
| Coating liquid for electroconductive layer 13 | Metal oxide particle 13 | 100 |
| Coating liquid for electroconductive layer 14 | Metal oxide particle 14 | 100 |
| Coating liquid for electroconductive layer 15 | Metal oxide particle 15 | 100 |
| Coating liquid for electroconductive layer 16 | Metal oxide particle 16 | 100 |
| Coating liquid for electroconductive layer 17 | Metal oxide particle 17 | 100 |
| Coating liquid for electroconductive layer 18 | Metal oxide particle 18 | 100 |
| Coating liquid for electroconductive layer 19 | Metal oxide particle 1 | 100 |
| Coating liquid for electroconductive layer 20 | Metal oxide particle 1 | 100 |
| Coating liquid for electroconductive layer 21 | Metal oxide particle 1 | 100 |
| Coating liquid for electroconductive layer 22 | Metal oxide particle 1 | 100 |
| Coating liquid for electroconductive layer 23 | Metal oxide particle 19 | 100 |

TABLE 2-continued

| Coating liquid for electroconductive layer No. | Metal oxide particle No. | Amount of particle used (parts) |
|---|---|---|
| Coating liquid for electroconductive layer 24 | Metal oxide particle 1 | 80 |
| Coating liquid for electroconductive layer 25 | Metal oxide particle 1 | 60 |
| Coating liquid for electroconductive layer 26 | Metal oxide particle 1 | 120 |
| Coating liquid for electroconductive layer 27 | Metal oxide particle 1 | 140 |
| Coating liquid for electroconductive layer 28 | Metal oxide particle 20 | 100 |
| Coating liquid for electroconductive layer 29 | Metal oxide particle 1 | 100 |
| Coating liquid for electroconductive layer 30 | Metal oxide particle 21 | 100 |
| Coating liquid for electroconductive layer 31 | Metal oxide particle 22 | 100 |
| Coating liquid for electroconductive layer 32 | Metal oxide particle 23 | 100 |
| Coating liquid for electroconductive layer 33 | Metal oxide particle 16 | 100 |
| Coating liquid for electroconductive layer 34 | Metal oxide particle 16 | 100 |
| Coating liquid for electroconductive layer 35 | Metal oxide particle 16 | 100 |
| Coating liquid for electroconductive layer C1 | Metal oxide particle C1 | 100 |
| Coating liquid for electroconductive layer C2 | Metal oxide particle C2 | 100 |
| Coating liquid for electroconductive layer C3 | Metal oxide particle C3 | 100 |
| Coating liquid for electroconductive layer C4 | Metal oxide particle C4 | 100 |
| Coating liquid for electroconductive layer C5 | Metal oxide particle C5 | 100 |
| Coating liquid for electroconductive layer C6 | Metal oxide particle C6 | 100 |
| Coating liquid for electroconductive layer C7 | Metal oxide particle C7 | 100 |
| Coating liquid for electroconductive layer C8 | Metal oxide particle C8 | 100 |

<Production of Electrophotographic Photosensitive Member>

(Electrophotographic Photosensitive Member 1)

An aluminum cylinder (JIS-A3003, aluminum alloy) produced by a production method including extrusion and drawing, having a length of 257 mm and a diameter of 24 mm, was used as a support.

The support was dip coated with coating liquid 1 for an electroconductive layer under a normal temperature and normal humidity (23° C./50% RH) environment, and the resulting coating film was dried and thermally cured at 150° C. for 30 minutes, thereby forming an electroconductive layer having a thickness of 20 μm. The volume resistivity of the electroconductive layer was measured by the above method and was found to be $1\times10^9$ Ω·cm.

Next, 4.5 parts of N-methoxymethylated nylon (trade name: Toresin EF-30T, produced by Nagase ChemteX Corporation) and 1.5 parts of a copolymerized nylon resin (trade name: Amilan CM8000, produced by Toray Industries, Inc.) were dissolved in a mixed solvent of 65 parts of methanol/30 parts of n-butanol, thereby preparing coating liquid 1 for an undercoat layer. The electroconductive layer was dip coated with the coating liquid 1 for an undercoat layer, and the resulting coating film was dried at 70° C. for 6 minutes, thereby forming an undercoat layer having a thickness of 0.85 μm.

Next, 10 parts of a hydroxygallium phthalocyanine crystal (charge generation material) having a crystal form having strong peaks at Bragg angles (2θ±0.2°) of 7.5°, 9.9°, 16.3°, 18.6°, 25.1° and 28.3° in CuKα characteristic X-ray diffraction, 5 parts of polyvinyl butyral (trade name: S-LEC BX-1, produced by Sekisui Chemical Co., Ltd.) and 250 parts of cyclohexanone were placed in a sand mill using glass beads having a diameter of 0.8 mm, and subjected to a dispersion treatment in a condition of a dispersion treatment time of 3 hours, and thereafter 250 parts of ethyl acetate was added thereto, thereby preparing a coating liquid for a charge generation layer. The undercoat layer was dip coated with the coating liquid for a charge generation layer, and the resulting coating film was dried at 100° C. for 10 minutes, thereby forming a charge generation layer having a thickness of 0.15 μm.

Next, 6.0 parts of an amine compound (charge transport material) represented by the following formula (CT-1), 2.0 parts of an amine compound (charge transport material) represented by the following formula (CT-2), 10 parts of bisphenol Z type polycarbonate (trade name: Z400, produced by Mitsubishi Engineering-Plastics Corporation), and 0.36 parts of siloxane-modified polycarbonate ((B-1):(B-2) =95:5 (molar ratio)) having a repeating structural unit represented by the following formula (B-1) and a repeating structural unit represented by the following formula (B-2) and having a terminal structure represented by the following formula (B-3) were dissolved in a mixed solvent of 60 parts of o-xylene/40 parts of dimethoxymethane/2.7 parts of methyl benzoate, thereby preparing a coating liquid for a charge transport layer. The charge generation layer was dip coated with the coating liquid for a charge transport layer, and the resulting coating film was dried at 125° C. for 30 minutes, thereby forming a charge transport layer having a thickness of 12.0 μm.

(CT-1)

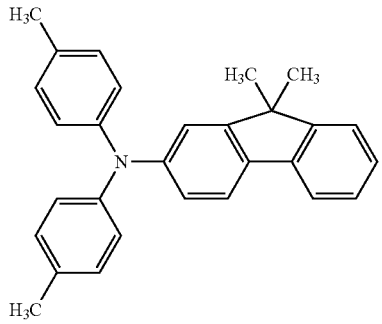

(CT-2)

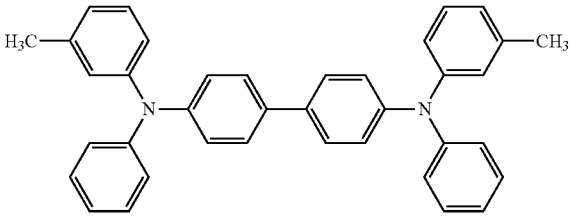

(B-1)

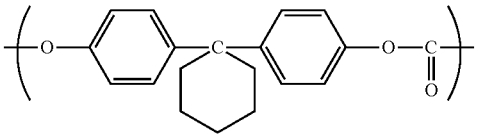

-continued (B-2)

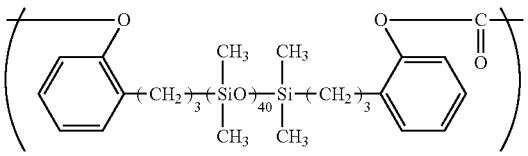

(B-3)

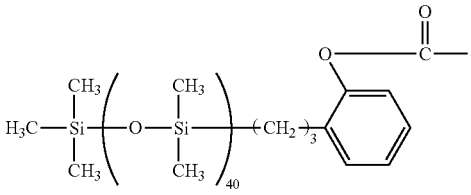

As described above, electrophotographic photosensitive member 1 whose surface layer was a charge transport layer was produced.

(Electrophotographic Photosensitive Members 2 to 25, 27 to 32, 34 to 36 and C1 to C8)

Electrophotographic photosensitive members 2 to 25, 27 to 32, 34 to 36 and C1 to CS, of which the respective charge transport layers were the surface layer, were manufactured in the same operation as in the manufacture of the electrophotographic photosensitive member 1, except that the coating liquid for the electroconductive layer, employed in the manufacture of the electrophotographic photosensitive member, was changed from the coating liquid 1 for the electroconductive layer to coating liquids 2 to 25, 27 to 32 and 34 to 36 and C1 to C8 for the electroconductive layer, respectively, and furthermore, the film thickness of the electroconductive layer was changed as shown in Table 3. The volume resistivity of the electroconductive layer was measured in the same manner as in electrophotographic photosensitive member 1. The results are shown in Table 3.

(Electrophotographic Photosensitive Member 26)

An electrophotographic photosensitive member 26 of which the charge transport layer was the surface layer was manufactured in the same operation as in the manufacture of the electrophotographic photosensitive member 1, except that the undercoat layer was not formed in the manufacture of the electrophotographic photosensitive member.

The volume resistivity of the electroconductive layer was measured in the same manner as in the electrophotographic photosensitive member 1. The results are shown in Table 3.

(Electrophotographic Photosensitive Members 33 and 38 to 40)

The electrophotographic photosensitive members 33 and 38 to 40, of which the respective charge transport layers were the surface layer, were manufactured in the same operation as in the manufacture of the electrophotographic photosensitive member 1, except that the coating liquid for the electroconductive layer, employed in the manufacture of the electrophotographic photosensitive member, was changed from the coating liquid 1 for the electroconductive layer to the coating liquids 29 and 33 to 35 for the electroconductive layer, respectively, and in addition, the temperature of drying and thermal curing of the coating film was changed to 170° C. The volume resistivity of the electroconductive layer was measured in the same manner as in the electrophotographic photosensitive member 1. The results are shown in Table 3.

(Electrophotographic Photosensitive Member 37)

An electrophotographic photosensitive member 37 of which the charge transport layer was the surface layer was manufactured in the same operation as in the manufacture of the electrophotographic photosensitive member 16, except that the undercoat layer was not formed in the manufacture of the electrophotographic photosensitive member.

The volume resistivity of the electroconductive layer was measured in the same manner as in the electrophotographic photosensitive member 1. The results are shown in Table 3.

(Electrophotographic Photosensitive Member 41)

An electrophotographic photosensitive member 41 of which the charge transport layer is the surface layer was manufactured in the same operation as in the manufacture of the electrophotographic photosensitive member 38, except that the charge generation material employed for the charge generation layer was changed to a Y-type oxytitanium phthalocyanine crystal having a peak at Bragg angle of 27.3° (2θ±0.2°) in CuKα characteristic X-ray diffraction, in the manufacture of the electrophotographic photosensitive member.

The volume resistivity of the electroconductive layer was measured in the same manner as in the electrophotographic photosensitive member 1. The results are shown in Table 3.

(Electrophotographic Photosensitive Member 42)

An electrophotographic photosensitive member 42 of which the charge transport layer is the surface layer was manufactured in the same operation as in the manufacture of the electrophotographic photosensitive member 39, except that the charge generation material which was employed for the charge generation layer was changed to a Y-type oxytitanium phthalocyanine crystal having a peak at Bragg angle of 27.3° (2θ±0.2°) in CuKα characteristic X-ray diffraction, in the manufacture of the electrophotographic photosensitive member.

The volume resistivity of the electroconductive layer was measured in the same manner as in the electrophotographic photosensitive member 1. The results are shown in Table 3.

(Electrophotographic Photosensitive Member 43)

An electrophotographic photosensitive member 43 of which the charge transport layer is the surface layer was manufactured in the same operation as in the manufacture of the electrophotographic photosensitive member 40, except that the charge generation material which was employed for the charge generation layer was changed to a Y-type oxytitanium phthalocyanine crystal having a peak at Bragg angle of 27.3° (2θ±0.2°) in CuKα characteristic X-ray diffraction, in the manufacture of the electrophotographic photosensitive member.

The volume resistivity of the electroconductive layer was measured in the same manner as in the electrophotographic photosensitive member 1. The results are shown in Table 3.

(Electrophotographic Photosensitive Member 44)

An electrophotographic photosensitive member 44 of which the charge transport layer was the surface layer was manufactured in the same operation as in the manufacture of the electrophotographic photosensitive member 1, except that in the manufacture of electrophotographic photosensitive member, the formation of the undercoat layer was changed as follows.

Rutile-type titanium oxide particles having an average primary particle size of 50 nm in an amount of 100 parts were mixed with 500 parts of toluene by stirring, 35 parts of vinyltrimethoxysilane was added thereto, and the mixture was stirred for 8 hours. Thereafter, the toluene was distilled off by reduced-pressure distillation, the rest was baked at 120° C. for 3 hours, and the rutile type titanium oxide particles surface-treated with vinyltrimethoxysilane were obtained.

Glass beads having a diameter of 1 mm in an amount of 120 parts were added into 4.5 parts of N-methoxymethylated nylon (trade name: TORESIN EF-30T, manufactured by Nagase ChemteX Corporation), 1.5 parts of a copolymerized nylon resin (trade name: Amilan CM 8000, produced by Toray Industries, Inc.), 18 parts of rutile type titanium oxide particles obtained by the above described procedure and were surface-treated with vinyltrimethoxysilane, 65 parts of methanol and 30 parts of n-butanol; the mixture was subjected to dispersion treatment with the use of a paint shaker for 6 hours; and a dispersion liquid was obtained. The glass beads were removed from the dispersion liquid by a mesh, the rest was pressurized and filtrated with the use of a PTFE filter paper (trade name: PF060, produced by Toyo Roshi Kaisha, Ltd.), and thereby a coating liquid 2 for the undercoat layer was prepared. The electroconductive layer was dip-coated with this coating liquid 2 for the undercoat layer, the obtained coating film was dried at 100° C. for 10 minutes, and thereby an undercoat layer of which the film thickness was 2.0 μm was formed.

The volume resistivity of the electroconductive layer was measured in the same manner as in the electrophotographic photosensitive member 1. The results are shown in Table 3.

(Analysis of Electroconductive Layer of Electrophotographic Photosensitive Member)

Five sections each 5 mm square were cut out from the electrophotographic photosensitive member manufactured in the above description; thereafter the charge transport layer and the charge generation layer of each of the sections were wiped with chlorobenzene, methyl ethyl ketone and methanol; and the electroconductive layer was exposed. A sample piece for observation was thus obtained, and five pieces thereof were prepared with respect to each electrophotographic photosensitive member.

Firstly, one sample piece was used with respect to each of the electrophotographic photosensitive members, the electroconductive layer was thinned to a thickness of 150 nm by an FIB-μ sampling method with the use of a focused ion beam processing observation apparatus (trade name: FB-2000A, manufactured by Hitachi High-Tech Manufacturing & Service Corp.), and the composition of the electroconductive layer was analyzed with the use of a field emission type electron microscope (HRTEM) (trade name: JEM-2100F, manufactured by JEOL Ltd.) and an energy dispersive X-ray analyzer (EDX) (trade name: JED-2300T, manufactured by JEOL Ltd.). Herein, as for the measurement conditions for EDX, the acceleration voltage was 200 kV and the beam diameter was 1.0 nm.

The diameter of the core material and the layer thickness of the covering layer were determined for each particle of 100 pieces of the metal oxide particles, from the obtained EDX image, and the ratio of the average primary particle size of the core material to the average layer thickness of the covering layer was calculated from the arithmetic averages of the diameters and the thicknesses.

Next, the remaining four sample pieces were used with respect to each electrophotographic photosensitive member, and the electroconductive layer of each electrophotographic photosensitive member was observed in the form of a three dimensional structure of 2 μm×2 μm×2 μm by Slice & View of FIB-SEM. The content of particles in the total volume of the electroconductive layer was calculated from the difference in the contrast of Slice & View in an FIB-SEM. In the present embodiment, the conditions for Slice & View were set as follows.

Processing of sample for analysis: FIB method

Processing and observation apparatus: NVision 40 manufactured by SII/Zeiss

Slice interval: 10 nm

Observation conditions:

Accelerating voltage: 1.0 kV

Sample tilting: 54°

WD: 5 mm

Detector: BSE detector

Aperture: 60 μm, high current

ABC: ON

Image resolution: 1.25 nm/pixel

The analytical region was 2 μm in length×2 μm in width, and the information on each cross section was summed up, to determine the volume V per unit of 2 μm in length×2 μm in width×2 μm in thickness (8 $\mu m^3$). The measurement environment was as follows: temperature: 23° C.; and pressure: $1\times10^{-4}$ Pa. Herein, Strata 400S (sample tilting: 52°) manufactured by FEI Company could also be used as the processing and observation apparatus. The information on each cross section was obtained by image analysis of the area of the metal oxide particle specified in the present disclosure or the metal oxide particle used in Comparative Examples. The image analysis was performed using image analysis software: Image-Pro Plus manufactured by Media Cybernetics, Inc.

Based on the resulting information, the volume V of the metal oxide particle in the present disclosure or the metal oxide particle used in Comparative Examples in a volume of 2 μm×2 μm×2 μm (unit volume: 8 $\mu m^3$) was determined with respect to each of the four sample pieces. Thus, the (V $\mu m^3$/8 $\mu m^3$×100) was calculated. The average value of the volumes (V $\mu m^3$/8 $\mu m^3$×100) of the four samples was defined as the content [% by volume] of the metal oxide particle in the present disclosure or the metal oxide particle used in Comparative Examples in the electroconductive layer relative to the total volume of the electroconductive layer. The results are shown in Table 3.

TABLE 3

| Example No. | Electrophotographic photosensitive member No. | Electroconductive layer: Coating liquid for electroconductive layer No. | Film thickness (μm) | Content of particle in total volume of electroconductive layer (% by volume) | Luminosity of film (L) | Volume resistivity [Ω · cm] | Metal oxide particle Average primary particle size of core material/ average layer thickness of covering layer |
|---|---|---|---|---|---|---|---|
| Example 1 | Electrophotographic photosensitive member 1 | Coating liquid for electroconductive layer 1 | 20 | 35 | 70 | $1 \times 10^{9}$ | 10 |
| Example 2 | Electrophotographic photosensitive member 2 | Coating liquid for electroconductive layer 2 | 20 | 35 | 60 | $5 \times 10^{8}$ | 10 |
| Example 3 | Electrophotographic photosensitive member 3 | Coating liquid for electroconductive layer 3 | 20 | 35 | 80 | $1 \times 10^{10}$ | 10 |
| Example 4 | Electrophotographic photosensitive member 4 | Coating liquid for electroconductive layer 4 | 20 | 35 | 90 | $1 \times 10^{11}$ | 10 |
| Example 5 | Electrophotographic photosensitive member 5 | Coating liquid for electroconductive layer 5 | 20 | 35 | 50 | $1 \times 10^{8}$ | 10 |
| Example 6 | Electrophotographic photosensitive member 6 | Coating liquid for electroconductive layer 6 | 20 | 35 | 80 | $1 \times 10^{10}$ | 15 |
| Example 7 | Electrophotographic photosensitive member 7 | Coating liquid for electroconductive layer 7 | 20 | 35 | 65 | $5 \times 10^{8}$ | 5 |
| Example 8 | Electrophotographic photosensitive member 8 | Coating liquid for electroconductive layer 8 | 20 | 35 | 65 | $5 \times 10^{8}$ | 5 |
| Example 9 | Electrophotographic photosensitive member 9 | Coating liquid for electroconductive layer 9 | 20 | 35 | 60 | $5 \times 10^{8}$ | 1 |
| Example 10 | Electrophotographic photosensitive member 10 | Coating liquid for electroconductive layer 10 | 20 | 35 | 55 | $1 \times 10^{8}$ | 0.8 |
| Example 11 | Electrophotographic photosensitive member 11 | Coating liquid for electroconductive layer 11 | 20 | 35 | 70 | $1 \times 10^{10}$ | 20 |
| Example 12 | Electrophotographic photosensitive member 12 | Coating liquid for electroconductive layer 12 | 20 | 35 | 80 | $1 \times 10^{11}$ | 50 |
| Example 13 | Electrophotographic photosensitive member 13 | Coating liquid for electroconductive layer 13 | 20 | 35 | 90 | $1 \times 10^{12}$ | 100 |
| Example 14 | Electrophotographic photosensitive member 14 | Coating liquid for electroconductive layer 14 | 20 | 35 | 65 | $8 \times 10^{8}$ | 10 |
| Example 15 | Electrophotographic photosensitive member 15 | Coating liquid for electroconductive layer 15 | 20 | 35 | 60 | $5 \times 10^{8}$ | 10 |
| Example 16 | Electrophotographic photosensitive member 16 | Coating liquid for electroconductive layer 16 | 20 | 35 | 75 | $3 \times 10^{12}$ | 10 |
| Example 17 | Electrophotographic photosensitive member 17 | Coating liquid for electroconductive layer 17 | 20 | 35 | 70 | $6 \times 10^{8}$ | 10 |
| Example 18 | Electrophotographic photosensitive member 18 | Coating liquid for electroconductive layer 18 | 20 | 35 | 65 | $2 \times 10^{8}$ | 10 |
| Example 19 | Electrophotographic photosensitive member 19 | Coating liquid for electroconductive layer 19 | 20 | 35 | 70 | $5 \times 10^{8}$ | 10 |
| Example 20 | Electrophotographic photosensitive member 20 | Coating liquid for electroconductive layer 20 | 20 | 35 | 70 | $5 \times 10^{9}$ | 10 |
| Example 21 | Electrophotographic photosensitive member 21 | Coating liquid for electroconductive layer 21 | 20 | 35 | 70 | $2 \times 10^{10}$ | 10 |
| Example 22 | Electrophotographic photosensitive member 22 | Coating liquid for electroconductive layer 22 | 20 | 35 | 70 | $4 \times 10^{11}$ | 10 |

TABLE 3-continued

| Example No. | Electrophotographic photosensitive member No. | Electroconductive layer: Coating liquid for electroconductive layer No. | Film thickness (μm) | Content of particle in total volume of electroconductive layer (% by volume) | Luminosity of film (L) | Volume resistivity [Ω · cm] | Metal oxide particle Average primary particle size of core material/ average layer thickness of covering layer |
|---|---|---|---|---|---|---|---|
| Example 23 | Electrophotographic photosensitive member 23 | Coating liquid for electroconductive layer 1 | 10 | 35 | 70 | $1 \times 10^{9}$ | 10 |
| Example 24 | Electrophotographic photosensitive member 24 | Coating liquid for electroconductive layer 1 | 1 | 35 | 70 | $5 \times 10^{8}$ | 10 |
| Example 25 | Electrophotographic photosensitive member 25 | Coating liquid for electroconductive layer 1 | 30 | 35 | 70 | $2 \times 10^{9}$ | 10 |
| Example 26 | Electrophotographic photosensitive member 26 | Coating liquid for electroconductive layer 1 | 20 | 35 | 70 | $1 \times 10^{9}$ | 10 |
| Example 27 | Electrophotographic photosensitive member 27 | Coating liquid for electroconductive layer 23 | 20 | 35 | 70 | $1 \times 10^{9}$ | 10 |
| Example 28 | Electrophotographic photosensitive member 28 | Coating liquid for electroconductive layer 24 | 20 | 30 | 73 | $8 \times 10^{9}$ | 10 |
| Example 29 | Electrophotographic photosensitive member 29 | Coating liquid for electroconductive layer 25 | 20 | 20 | 75 | $7 \times 10^{10}$ | 10 |
| Example 30 | Electrophotographic photosensitive member 30 | Coating liquid for electroconductive layer 26 | 20 | 39 | 67 | $6 \times 10^{8}$ | 10 |
| Example 31 | Electrophotographic photosensitive member 31 | Coating liquid for electroconductive layer 27 | 20 | 45 | 65 | $1 \times 10^{8}$ | 10 |
| Example 32 | Electrophotographic photosensitive member 32 | Coating liquid for electroconductive layer 28 | 20 | 35 | 70 | $1 \times 10^{9}$ | 10 |
| Example 33 | Electrophotographic photosensitive member 33 | Coating liquid for electroconductive layer 29 | 20 | 35 | 75 | $8 \times 10^{8}$ | 10 |
| Example 34 | Electrophotographic photosensitive member 34 | Coating liquid for electroconductive layer 30 | 20 | 35 | 70 | $5 \times 10^{9}$ | 10 |
| Example 35 | Electrophotographic photosensitive member 35 | Coating liquid for electroconductive layer 31 | 20 | 35 | 70 | $1 \times 10^{10}$ | 10 |
| Example 36 | Electrophotographic photosensitive member 36 | Coating liquid for electroconductive layer 32 | 20 | 35 | 70 | $1 \times 10^{11}$ | 10 |
| Example 37 | Electrophotographic photosensitive member 37 | Coating liquid for electroconductive layer 16 | 20 | 35 | 75 | $3 \times 10^{12}$ | 10 |
| Example 38 | Electrophotographic photosensitive member 38 | Coating liquid for electroconductive layer 33 | 20 | 35 | 75 | $3 \times 10^{12}$ | 10 |
| Example 39 | Electrophotographic photosensitive member 39 | Coating liquid for electroconductive layer 34 | 20 | 35 | 75 | $3 \times 10^{12}$ | 10 |
| Example 40 | Electrophotographic photosensitive member 40 | Coating liquid for electroconductive layer 35 | 20 | 35 | 75 | $3 \times 10^{12}$ | 10 |
| Example 41 | Electrophotographic photosensitive member 41 | Coating liquid for electroconductive layer 33 | 20 | 35 | 75 | $3 \times 10^{12}$ | 10 |
| Example 42 | Electrophotographic photosensitive member 42 | Coating liquid for electroconductive layer 34 | 20 | 35 | 75 | $3 \times 10^{12}$ | 10 |
| Example 43 | Electrophotographic photosensitive member 43 | Coating liquid for electroconductive layer 35 | 20 | 35 | 75 | $3 \times 10^{12}$ | 10 |
| Example 44 | Electrophotographic photosensitive member 44 | Coating liquid for electroconductive layer 1 | 20 | 35 | 70 | $1 \times 10^{9}$ | 10 |

TABLE 3-continued

| Example No. | Electrophotographic photosensitive member No. | Electroconductive layer: Coating liquid for electroconductive layer No. | Film thickness (μm) | Content of particle in total volume of electroconductive layer (% by volume) | Luminosity of film (L) | Volume resistivity [Ω · cm] | Metal oxide particle Average primary particle size of core material/ average layer thickness of covering layer |
|---|---|---|---|---|---|---|---|
| Comparative Example 1 | Electrophotographic photosensitive member C1 | Coating liquid for electroconductive layer C1 | 20 | 35 | 20 | $1 \times 10^{8}$ | — |
| Comparative Example 2 | Electrophotographic photosensitive member C2 | Coating liquid for electroconductive layer C2 | 20 | 35 | 70 | $1 \times 10^{10}$ | — |
| Comparative Example 3 | Electrophotographic photosensitive member C3 | Coating liquid for electroconductive layer C3 | 20 | 35 | 90 | $1 \times 10^{13}$ | — |
| Comparative Example 4 | Electrophotographic photosensitive member C4 | Coating liquid for electroconductive layer C4 | 20 | 35 | 70 | $5 \times 10^{10}$ | 10 |
| Comparative Example 5 | Electrophotographic photosensitive member C5 | Coating liquid for electroconductive layer C5 | 20 | 35 | 50 | $1 \times 10^{10}$ | 10 |
| Comparative Example 6 | Electrophotographic photosensitive member C6 | Coating liquid for electroconductive layer C6 | 20 | 35 | 35 | $1 \times 10^{8}$ | 10 |
| Comparative Example 7 | Electrophotographic photosensitive member C7 | Coating liquid for electroconductive layer C7 | 20 | 35 | 70 | $1 \times 10^{12}$ | 10 |
| Comparative Example 8 | Electrophotographic photosensitive member C8 | Coating liquid for electroconductive layer C8 | 20 | 35 | 50 | $4 \times 10^{11}$ | 10 |

[Evaluation]

(Evaluation of Initial Sensitivity, and Evaluation of Effect of Reducing Fluctuation of Light Portion Potential During Repeated Use)

Each of the electrophotographic photosensitive members that were manufactured in the above description was mounted to a laser beam printer Color Laser Jet Enterprise M552 manufactured by Hewlett-Packard Company, and was subjected to a sheet feeding durability test under an environment of temperature 23° C./relative humidity 50%. In the sheet feeding durability test, a printing operation was performed in an intermittent mode where a character image with a printing ratio of 2% was output on a letter sheet one sheet by one sheet, thereby performing outputting 10,000 sheets of the image. Then, a potential at the time of exposure (light portion potential) was measured at the initiation of the sheet feeding durability test and at the end of the image output of 10,000 sheets. The potential was measured with the use of one sheet of a black solid image, and with a printer which was modified so that the charge potential (dark portion potential) was −500 V and the amount of image exposure light was 0.4 μJ/cm$^2$ on the surface of the electrophotographic photosensitive member. The light portion potential (initial sensitivity) at the initial stage (at initiation of sheet feeding durability test) was designated as VL, and the light portion potential after the image output of 10,000 sheets was designated as VL'. Then, the variation ΔVL (=|VL'|−|VL|) of the light portion potential was determined, which was a difference between the light portion potential VL' after the completion of the output of 10,000 images and the light portion potential VL at the initial stage. The results are shown in Table 4.

TABLE 4

| Example No. | Initial sensitivity under normal temperature and normal humidity environment VL (V) | Effect of reducing fluctuation of potential during repeated use under normal temperature and normal humidity environment ΔVL (V) | Effect of reducing fluctuation of potential during repeated use under high temperature and high humidity environment ΔVL (V) |
|---|---|---|---|
| Example 1 | 110 | 15 | 15 |
| Example 2 | 120 | 10 | 10 |
| Example 3 | 100 | 20 | 20 |
| Example 4 | 90 | 25 | 25 |
| Example 5 | 135 | 10 | 10 |
| Example 6 | 100 | 20 | 20 |
| Example 7 | 115 | 10 | 10 |
| Example 8 | 115 | 10 | 10 |
| Example 9 | 120 | 10 | 10 |
| Example 10 | 127 | 10 | 10 |
| Example 11 | 110 | 10 | 10 |
| Example 12 | 100 | 20 | 20 |
| Example 13 | 90 | 25 | 25 |
| Example 14 | 115 | 10 | 10 |
| Example 15 | 120 | 10 | 10 |
| Example 16 | 105 | 15 | 5 |
| Example 17 | 110 | 10 | 12 |
| Example 18 | 115 | 10 | 15 |
| Example 19 | 110 | 10 | 10 |
| Example 20 | 110 | 10 | 10 |
| Example 21 | 110 | 10 | 10 |
| Example 22 | 110 | 10 | 10 |
| Example 23 | 110 | 10 | 10 |
| Example 24 | 110 | 10 | 10 |

TABLE 4-continued

| Example No. | Initial sensitivity under normal temperature and normal humidity environment VL (V) | Effect of reducing fluctuation of potential during repeated use under normal temperature and normal humidity environment ΔVL (V) | Effect of reducing fluctuation of potential during repeated use under high temperature and high humidity environment ΔVL (V) |
|---|---|---|---|
| Example 25 | 110 | 10 | 10 |
| Example 26 | 110 | 10 | 10 |
| Example 27 | 110 | 10 | 10 |
| Example 28 | 107 | 10 | 10 |
| Example 29 | 105 | 15 | 15 |
| Example 30 | 113 | 10 | 10 |
| Example 31 | 115 | 10 | 10 |
| Example 32 | 110 | 15 | 15 |
| Example 33 | 105 | 15 | 15 |
| Example 34 | 110 | 15 | 10 |
| Example 35 | 110 | 15 | 8 |
| Example 36 | 110 | 15 | 6 |
| Example 37 | 115 | 15 | 5 |
| Example 38 | 115 | 10 | 5 |
| Example 39 | 115 | 10 | 5 |
| Example 40 | 115 | 10 | 5 |
| Example 41 | 120 | 20 | 15 |
| Example 42 | 120 | 20 | 15 |
| Example 43 | 120 | 20 | 15 |
| Example 44 | 105 | 10 | 10 |
| Comparative Example 1 | 200 | 10 | 10 |
| Comparative Example 2 | 110 | 50 | 60 |
| Comparative Example 3 | 90 | 60 | 70 |
| Comparative Example 4 | 110 | 55 | 55 |
| Comparative Example 5 | 135 | 30 | 30 |
| Comparative Example 6 | 165 | 20 | 20 |
| Comparative Example 7 | 110 | 70 | 70 |
| Comparative Example 8 | 135 | 55 | 55 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-157748, filed Aug. 24, 2018, and Japanese Patent Application No. 2019-146615, filed Aug. 8, 2019, which are hereby incorporated by reference herein in their entirety.

What is claimed is:

1. An electrophotographic photosensitive member comprising a support, an electroconductive layer and a photosensitive layer in this order, wherein the electroconductive layer contains a binder material and a metal oxide particle;

the metal oxide particle has a core material containing a titanium oxide, and a covering layer which covers the core material and contains the titanium oxide; and when an oxygen deficiency ratio of the metal oxide particle is represented by A, an oxygen deficiency ratio of the core material is represented by B, and an oxygen deficiency ratio of the covering layer is represented by C, the following Expression (1) and Expression (2) are satisfied:

$$A \leq 2/100 \quad (1) \text{ and}$$

$$10 \times B < C \quad (2).$$

2. The electrophotographic photosensitive member according to claim 1, wherein 98 atomic % or more of metal elements contained in the core material are a titanium element.

3. The electrophotographic photosensitive member according to claim 2, wherein 90 atomic % or more of metal elements contained in the metal oxide particle are a titanium element.

4. The electrophotographic photosensitive member according to claim 3, wherein a luminosity of the electroconductive layer is 60 or more.

5. The electrophotographic photosensitive member according to claim 3, wherein an average primary particle size of the core material is 1 to 50 times an average layer thickness of the covering layer.

6. The electrophotographic photosensitive member according to claim 3, wherein a content of a niobium element or a tantalum element is 0.5 atomic % or less of metal elements contained in the covering layer.

7. The electrophotographic photosensitive member according to claim 6, wherein the electroconductive layer further contains an electron-accepting substance.

8. The electrophotographic photosensitive member according to claim 1, wherein a luminosity of the electroconductive layer is 60 or more.

9. The electrophotographic photosensitive member according to claim 1, wherein a volume resistivity of the electroconductive layer is $1.0 \times 10^8$ Ω·cm or more and $1.0 \times 10^{13}$ Ω·cm or less.

10. The electrophotographic photosensitive member according to claim 1, wherein a content of the metal oxide particle accounts for 20% by volume or more and 50% by volume or less of a total volume of the electroconductive layer.

11. The electrophotographic photosensitive member according to claim 1, wherein an average primary particle size of the core material is 1 to 50 times an average layer thickness of the covering layer.

12. A process cartridge that is detachably mountable on a main body of an electrophotographic apparatus, the process cartridge integrally supporting an electrophotographic photosensitive member and at least one unit selected from the group consisting of a charging unit, a developing unit, a transfer unit and a cleaning unit, wherein the electrophotographic photosensitive member comprises a support, an electroconductive layer and a photosensitive layer in this order, wherein the electroconductive layer contains a binder material and a metal oxide particle;

the metal oxide particle has a core material containing a titanium oxide, and a covering layer which covers the core material and contains the titanium oxide; and when an oxygen deficiency ratio of the metal oxide particle is represented by A, an oxygen deficiency ratio of the core material is represented by B, and an oxygen deficiency ratio of the covering layer is represented by C, the following Expression (1) and Expression (2) are satisfied:

$$A \leq 2/100 \quad (1) \text{ and}$$

$$10 \times B < C \quad (2).$$

13. An electrophotographic apparatus comprising an electrophotographic photosensitive member, a charging unit, an exposing unit, a developing unit and a transfer unit, wherein the electrophotographic photosensitive member comprises a support, an electroconductive layer and a photosensitive layer in this order, wherein the electroconductive layer contains a binder material and a metal oxide particle;

the metal oxide particle has a core material containing a titanium oxide, and a covering layer which covers the core material and contains the titanium oxide; and when an oxygen deficiency ratio of the metal oxide particle is represented by A, an oxygen deficiency ratio of the core material is represented by B, and an oxygen deficiency ratio of the covering layer is represented by C, the following Expression (1) and Expression (2) are satisfied:

$$A \leq 2/100 \quad (1) \text{ and}$$

$$10 \times B < C \quad (2).$$

* * * * *